United States Patent [19]

Dietz

[11] Patent Number: 5,054,436

[45] Date of Patent: Oct. 8, 1991

[54] FLUIDIZED BED COMBUSTION SYSTEM AND PROCESS FOR OPERATING SAME

[75] Inventor: David H. Dietz, Hampton, N.J.

[73] Assignee: Foster Wheeler Energy Corporation, Clinton, N.J.

[21] Appl. No.: 537,397

[22] Filed: Jun. 12, 1990

[51] Int. Cl.[5] ..... F22B 1/02

[52] U.S. Cl. ..... 122/4 D; 110/245; 110/347

[58] Field of Search ..... 110/235, 347; 122/4 D

[56] References Cited

U.S. PATENT DOCUMENTS

| | | | |
|---|---|---|---|
| 3,893,426 | 7/1975 | Bryers . | |
| 4,111,158 | 9/1978 | Reh et al. . | |
| 4,165,717 | 8/1979 | Reh et al. . | |
| 4,227,488 | 10/1980 | Stewart et al. . | |
| 4,338,283 | 7/1982 | Sakamoto et al. . | |
| 4,469,050 | 9/1984 | Korenberg . | |
| 4,594,967 | 6/1986 | Wolowodiuk . | |
| 4,617,877 | 10/1986 | Gamble . | |
| 4,665,864 | 5/1987 | Seshamani et al. . | |
| 4,682,567 | 7/1987 | Garcia-Mallol et al. . | |
| 4,682,948 | 7/1987 | Cohen | 122/4 D |
| 4,686,939 | 8/1987 | Stromberg . | |
| 4,694,758 | 9/1987 | Gorzegno et al. . | |
| 4,704,084 | 11/1987 | Liu et al. . | |
| 4,709,662 | 12/1987 | Rawdon . | |
| 4,716,856 | 1/1988 | Beisswender et al. . | |
| 4,761,131 | 8/1988 | Abdulally . | |
| 4,813,479 | 3/1989 | Wahlgren . | |
| 4,856,460 | 8/1989 | Wied et al. . | |
| 4,896,717 | 1/1990 | Campbell, Jr. et al. . | |
| 4,947,804 | 8/1990 | Abdulally . | |
| 4,962,711 | 10/1990 | Yamanchi et al. | 122/4 D |
| 4,969,930 | 11/1990 | Arpalahti . | |

*Primary Examiner*—Henry C. Yuen

*Attorney, Agent, or Firm*—Marvin A. Naigur

[57] ABSTRACT

A fluidized bed combustion system and method in which a recycle section is located integrally with the furnace section in an enclosure and operates as a combustor. Heat exchange surfaces are provided in at least one compartment of the combustor/heat exchanger for removing heat from the solids, and a bypass compartment is provided through which the solids directly pass to the furnace during start-up and low load conditions. Fluidizing air is discharged at the internal recirculation of the solids and a partition is located in the central portion of the furnace enclosure for introducing secondary air.

33 Claims, 2 Drawing Sheets

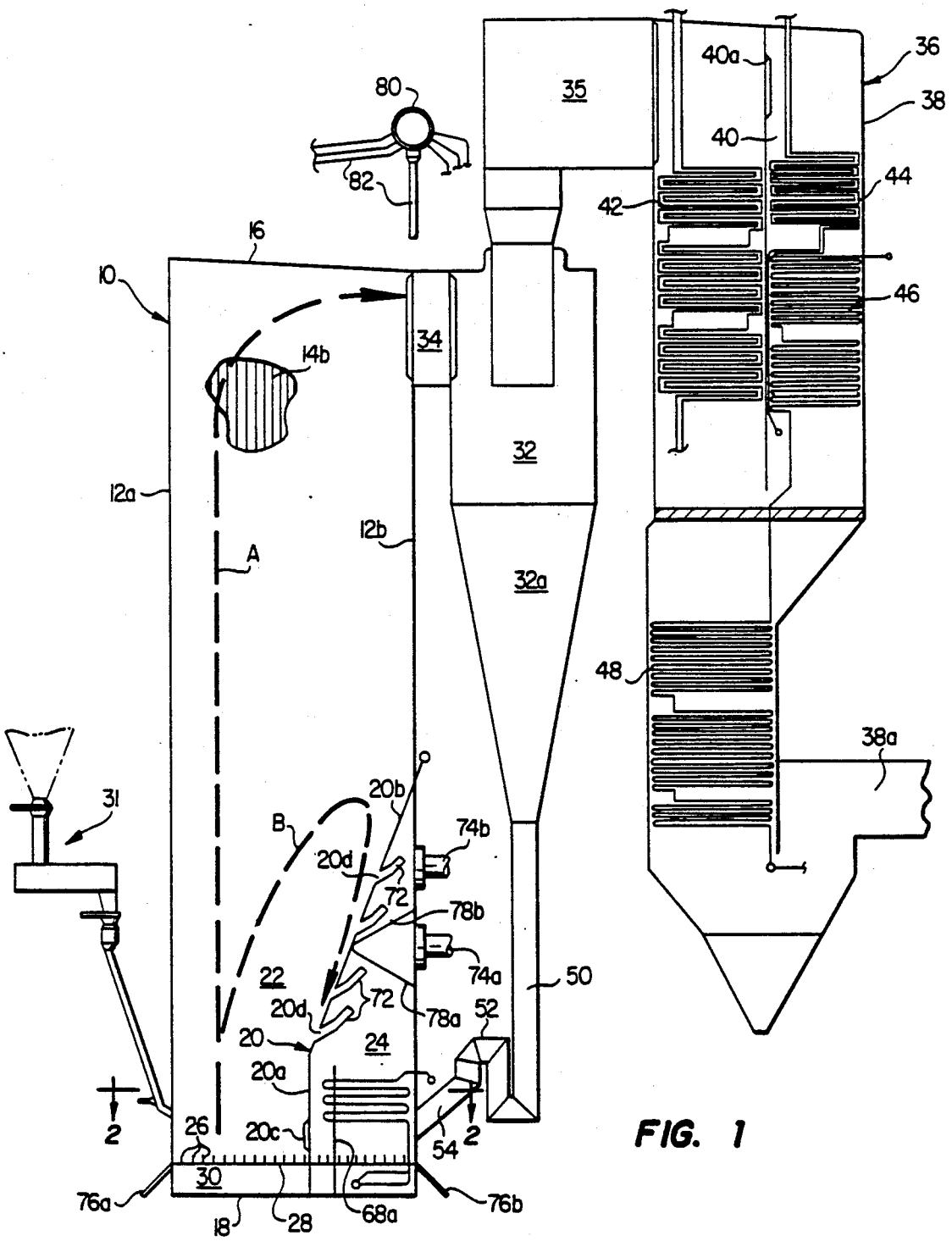
FIG. 1
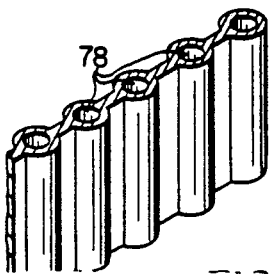

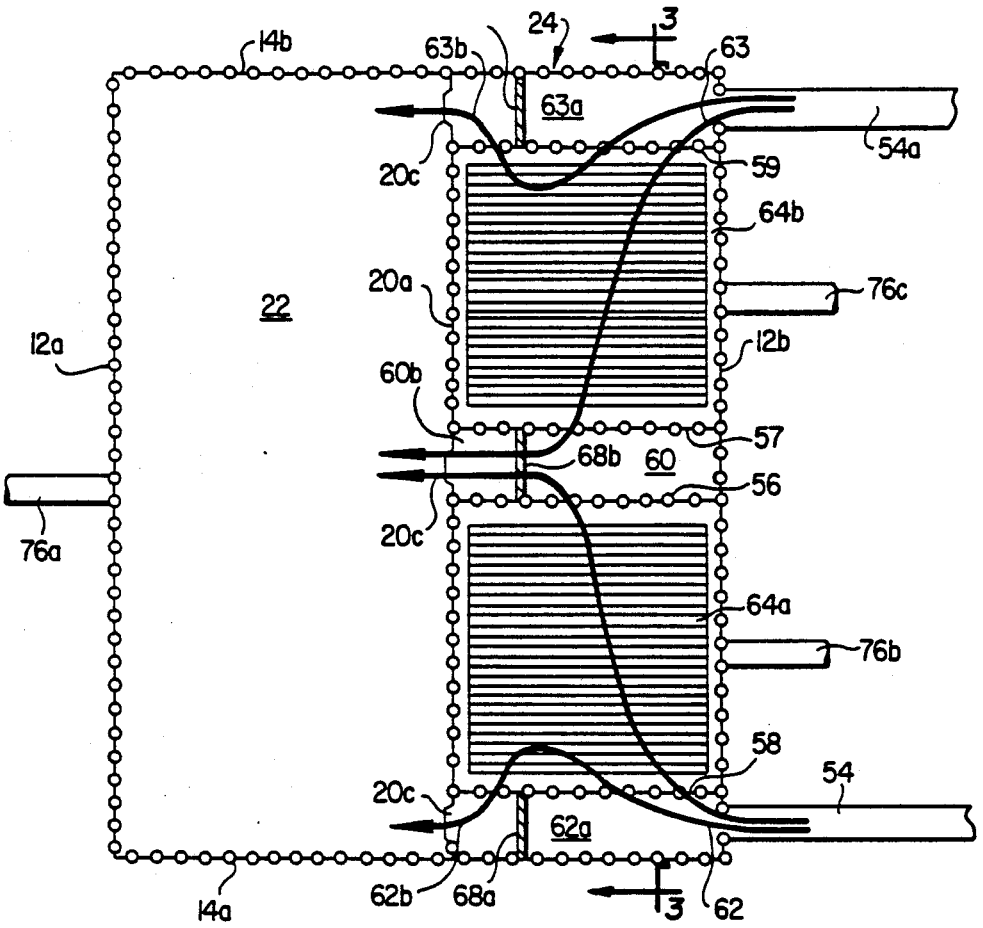
FIG. 2
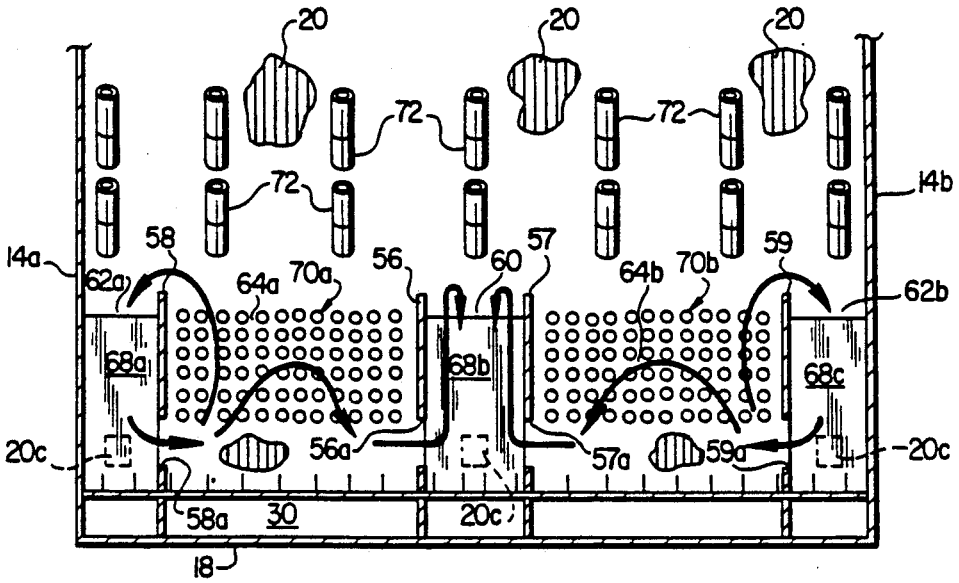

FLUIDIZED BED COMBUSTION SYSTEM AND PROCESS FOR OPERATING SAME

BACKGROUND OF THE INVENTION

This invention relates to a fluidized bed combustion system and a process of operating same and, more particularly, to such a system and process in which a multicompartment recycle combustor/heat exchanger is provided integrally with the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases and the solids entrained thereby from the fluidized bed. The solids are separated from the flue gases in the separator and the flue gases are passed to a heat recovery area while the solids are recycled back to the furnace through a seal pot or seal valve. All of the fuel is combusted and the heat of combustion is absorbed by water/steam-cooled tube surfaces forming the interior boundary of the furnace section and the heat recovery area. The recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, in order to reduce the emission of nitrous oxides, the amount of primary air supplied to the fluid bed must be limited to that below the ideal amount for complete combustion and secondary air is injected above the fluidized bed in sufficient quantities to ensure complete combustion. However, combustion efficiency can be severely reduce if there is no adequate mixing of the primary combustion air, the secondary combustion air and the sorbent.

Also in these types of fluidized beds, particulate fuel of a size extending over a relative wide range is utilized.

For example, a typical bed will contain relatively coarse particles of 350–850 microns in diameter which tend to form a dense bed in the lower furnace, and relatively fine particles of 75–225 microns in diameter which are entrained by the flue gases and recycled. This tends to reduce coarse particle entrainment and cause instability in the dense bed of coarse materials resulting in sluging or choking of the bed material and pressure fluctuations in the lower furnace.

SUMMARY OF THE INVENTION

It is therefore an object of the present invention to provide a fluidized bed combustion system and process in which the primary combustion air, the secondary air and the sorbent are completely and thoroughly mixed.

It is a still further object of the present invention to provide a system and process of the above type which utilizes a non-uniform primary air grid velocity profile to improve coarse particles entrainment, stabilize the dense bed of relatively coarse materials and reduce lower furnace pressure fluctuations.

It is a further object of the present invention to provide a system and process of the above type in which internal and external circulation of the particles are controlled.

It is a further object of the present invention to provide a system and process of the above type which utilizes a recycle combustor/heat exchanger disposed integral with the furnace section of the combustion system for removing heat from the separated solids before they are recycled back to the furnace and for combusting unburned fuel in the recycled solids.

It is a still further object of the present invention to provide a system and process of the above type in which the recycle combustion/heat exchanger includes a direct bypass for routing the separated solids directly to the furnace section without passing over any heat exchange surfaces, during start-up, shut-down, unit trip, and low load conditions.

It is a still further object of the present invention to provide a system and process of the above type in which multiple compartments are provided in the recycle heat exchanger and the flow of separated solids between compartments is controlled to increase the heat exchange efficiency.

It is a still further object of the present invention to provide a system and process of the above type in which sufficient air is provided to the recycle bubbling bed to combust the unburned fuel and increase the overall fuel combustion efficiency.

Toward the fulfillment of these and other objects, the system of the present invention includes a recycle bubbling bed formed integrally with the furnace which functions as a heat exchanger and a combustor. The flue gases and entrained particulate materials from a circulating fluidized bed in the furnace are separated, the flue gases are passed to a heat recovery area and the separated solids are passed to the recycle bubbling fluid bed. Coarse and fine particulate materials are recirculated internally and the primary combustion air, the secondary combustion air and the sorbent materials are mixed thoroughly. Heat exchange surfaces are provided in one compartment of the recycle bubbling bed to absorb combustion heat and the solids' sensible heat, and a bypass compartment is provided in another compartment through which the solids directly pass to the circulating bed in the furnace during start-up and low load conditions.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein:

FIG. 1 is a schematic representation depicting the system of the present invention;

FIG. 2 is an enlarged cross-sectional view taken along the line 2—2 of FIG. 1;

FIG. 3 is a cross-sectional view taken along the line 3—3 of FIG. 2; and

FIG. 4 is a partial, enlarged perspective view of a portion of a wall of the enclosure of the system of FIG. 1.

DESCRIPTION OF THE PREFERRED EMBODIMENT

The drawings depict the fluidized bed combustion system of the present invention used for the generation of steam and including an upright water-cooled enclosure, referred to in general by the reference numeral 10, having a front wall 12*a*, a rear wall 12*b* and two sidewalls 14*a* and 14*b*. The upper portion of the enclosure 10 is closed by a roof 16 and the lower portion includes a floor 18.

A partition 20 is disposed in the enclosure 10 and extends between the front wall 12*a* and the rear wall 12*b*. The partition 20 includes a vertical portion 20*a* extending from the floor 18 and parallel to the walls 12*a* and 12*b*, and an angled portion 20*b* extending from the upper end of the vertical portion to and through the rear wall 12*b*. The partition 20 divides the enclosure into a furnace section 22 and a recycle section 24. Three horizontally-spaced openings 20*c* (one of which is shown in FIG. 1) are provided in the vertical partition portion 20*a* and a plurality of vertically-spaced openings 20*d* are provided in the angled partition portion 20*b*.

A plurality of air distributor nozzles 26 are mounted in corresponding openings formed in a plate 28 extending across the lower portion of the enclosure 10. The plate 28 is spaced from the floor 18 to define an air plenum 30 which is adapted to receive air from an external source (not shown) and selectively distribute the air through the nozzles 26 to the section 22 and the section 24. Each nozzle 26 is of a conventional design and, as such, includes a control device to enable the velocity of the air passing therethrough to be controlled.

A coal feeder system, shown in general by the reference numeral 31, is provided adjacent to the front wall 12 for introducing particulate material containing fuel into the furnace section 22. Since the feeder system 31 operates in a conventional manner to spread the fuel into the lower portion of the furnace section 22 it will not be described in any further detail. It is understood that a particulate sorbent material can also be introduced into the furnace section 22 for absorbing the sulfur generated as a result of the combustion of the fuel. This sorbent material may be introduced through the feeder 31 or independently through openings in the walls 12*a*, 12*b*, 14*a*, or 14*b*.

The particulate fuel and sorbent material (hereinafter termed "solids") in the furnace section 22 is fluidized by the air from the plenum 30 as the air passes upwardly through the plate 28. This air promotes the combustion of the fuel in the solids and the resulting mixture of combustion gases and the air (hereinafter termed "flue gases") rises in the section 22 by forced convection and entrains a portion of the solids to form a column of decreasing solids density in the furnace section to a given elevation, above which the density remains substantially constant. Air is also selectively introduced through the nozzles 26 into the recycle section 24 in a manner to be described via the same air source that supplies the nozzle 26 in the furnace section 22.

A cyclone separator 32 extends adjacent the enclosure 10 and is connected thereto via a duct 34 extending from an outlet provided in the rear wall 12*b* of the enclosure 10 to an inlet provided through the separator wall. The separator 32 includes a hopper portion 32*a* extending downwardly therefrom.

The separator 32 receives the flue gases and the entrained particle material from the furnace section 22 in a manner to be described and operates in a conventional manner to disengage the solids from the flue gases due to the centrifugal forces created in the separator. The separated flue gases, which are substantially free of solids, pass, via a duct 35 located immediately above the separator 32, into a heat recovery section shown in general by the reference numeral 36.

The heat recovery section 32 includes an enclosure 38 divided by a vertical partition 40 into a first passage which houses a reheater 42, and a second passage which houses a primary superheater 44 and an upper economizer 46, all of which are formed by a plurality of heat exchange tubes extending in the path of the gases from the separator 32 as they pass through the enclosure 36. An opening 40*a* is provided in the upper portion of the partition 40 to permit a portion of the gases to flow into the passage containing the superheater 44 and the upper economizer 46. After passing across the reheater 42, superheater 44 and the economizer 46 in the two parallel passes, the gases pass through a lower economizer 48 before exiting the enclosure 38 through an outlet 38*a* formed in the rear wall thereof.

The separated solids in the separator 32 pass downwardly, by gravity, into and through the hopper portion 32*a* from which they pass, into and through a dipleg 50 and into a J-valve 52. A conduit 54 extends from the J-valve 52 to an opening provided through the rear wall 12*b* to pass the solids into the recycle section 24.

Although not shown in the drawings, it is understood that an additional separator is provided which is identical to the separator 32 and is disposed adjacent the separator 32 and behind the plane of the drawing. As shown in FIG. 2, a conduit 54*a* connects this additional separator to the recycle section 24.

In the recycle section 24, two vertical partitions 56 and 57 (FIGS. 2 and 3) extend upwardly from the floor 18 between, and in a spaced, parallel relation to, the sidewalls 14*a* and 14*b*. A partition 58 extends upwardly from the floor 18 and between the sidewall 14*a* and the partition 56, and a partition 59 extends upwardly from the floor 18 and between the partition 57 and the sidewall 14*b*. The upper ends of the partitions 58 and 59 are located at the same level as the upper ends of the partitions 56 and 57, and openings 56*a*, 57*a*, 58*a* and 59*a* extend through the lower end portions of the partitions 56, 57, 58 and 59, respectively, as viewed in FIG. 3.

Each of the partitions 56, 57, 58 and 59 are secured between the rear wall 12*b* and the partition 20.

A central, outlet compartment 60 is defined between the partitions 56 and 57 and two compartments 62 and 63 are defined between the sidewall 14*a* and the partition 58, and between the side wall 14*b* and the partition 59, respectively. Also, a compartment 64*a* is defined between the partitions 56 and 58, and a compartment 64*b* is defined between the partitions 57 and 59. Three transverse partitions 68*a*, 68*b* and 68*c* are disposed in the compartments 62, 60 and 63, respectively, and extend parallel to, and between, the rear wall 12*b* and the partition 20. The partition 68*a* divides the compartment 62 into an inlet compartment 62*a* and an outlet trough 62*b*, the partition 68*b* divides the compartment 60 into an inlet compartment 60*a* and an outlet trough 60*b*, and the partition 68*c* divides the compartment 63 into an inlet compartment 63*a* and an outlet trough 63*b*. As better shown in FIGS. 2 and 3, the three horizontally-spaced openings 20*c* provided in the vertical portion 20*a* of the partition 20 are in communication with the outlet troughs 60*b*, 62*b* and 63*b*, respectively.

Two banks 70*a* and 70*b* of heat exchange tubes are provided in the compartments 64*a* and 64*b*, respectively. Although not shown in the FIGS. 2 and 3 it is understood that the respective end portions of each tube in the tube banks 70*a* and 70*b* are connected to an inlet header and an outlet header (not shown).

As shown in FIG. 3, the partitions 56, 57, 58 and 59 divide that portion of the air plenum 30 extending below the recycle section 30 into sections extending immediately below the compartments 60*a*, 60*b*, 62*a*, 62*b*, 63*a*, 63*b*, 64*a* and 64*b*. A portion of the air discharge nozzles 26 extend upwardly from the plate 28 below each of the compartments 60*a*, 62*a*, 63*a*, 64*a* and 64*b* for introducing air into these compartments.

As shown in FIGS. 1 and 3, a plurality of nozzles 72 register with the openings 20*d*, respectively, in the partition portion 20*d*. A pair of vertically spaced secondary air inlets 74*a* and 74*b* register with openings in the rear wall 12*b* for introducing secondary air into the recycle section 24 at two levels.

A drain pipe 76*a* (FIGS. 1 and 2) extends from the furnace section 22 and a pair of drain pipes 76*b* and 76*c* are provided for the compartments 64*a* and 64*b* in the recycle section 24 for discharging spent bed material, in a conventional manner.

The front wall 12*a*, the rear wall 12*b*, the sidewalls 14*a* and 14*b*, the roof 16, the partitions 20, 56*a*, 56*b*, 58*a* and 58*b*, as well as the walls defining the separator 32 and the heat recovery enclosure 36 all are formed of membrane-type walls an example of which is depicted in FIG. 4. Each structure is formed by a plurality of finned tubes 78 disposed in a vertically extending, airtight, relationship with adjacent finned tubes being connected along their lengths.

As shown in FIG. 1, a portion of the tubes 78 forming the rear wall 12*b* are bent out of the plane of the latter wall, towards the partition section 20*b* to form a wall 78*a*, and back to the wall 12*b* to form a wall 78*b*. The walls 78*a* and 78*b* thus help support the partition section 20*b*. Although not clear from the drawing, it is, understood that the tubes 78 forming the wall 78*a* have no fins so that secondary air from the inlet 74*a* can pass therethrough, while the tubes 78 forming the wall 78*b* are formed as shown in FIG. 4 to prevent the passage of air therethrough and thus form a roof for the recycle section 24. As a result, secondary air from the inlet 74*a* is directed through the lower two rows of nozzles 72, and secondary air from the inlet 74*b* is directed through the upper two rows of nozzles 72.

A steam drum 80 (FIG. 1) is located above the enclosure 10 and, although not shown in the drawings, it is understood that a plurality of headers are disposed at the ends of the various walls and partitions described above. Also, a plurality of downcomers, pipes, risers, headers etc., some of which are shown by the reference numeral 82, are utilized to establish a steam and water flow circuit including the steam drum 80, the tubes 78 forming the aforementioned water tube walls and partitions and the tube banks 70*a* and 70*b*. The economizer 46 receives feedwater and discharges it to the drum 80 and the water is passed, in a predetermined sequence from the drum through this flow circuitry to convert the water to steam and heat the steam by the heat generated by combustion of the particulate fuel material in the furnace section and by the heat from the solids in the heat exchanger section 24 as will be described.

In operation, the solids are introduced into the furnace section 22 through the feeder system 31. Alternately, sorbent may also be introduced independently through openings in the walls 12*a*, 12*b*, 14*a* and 14*b*. Air from an external source is introduced at a sufficient pressure into that portion of the plenum 30 extending below the furnace section 22 and the air passes through the nozzles 26 disposed in the furnace section 22 at a sufficient quantity and velocity to fluidize the solids in the latter section and form a circulating fluidized bed as described above. Each nozzle 26 is adjusted so that the velocity of the air discharged therefrom increases from right-to-left as viewed in FIG. 1, i.e., the nozzles closest to the wall 12*a* discharge air at a relatively high velocity while the nozzles closest to the partition 20 discharge air at a relatively low velocity.

A lightoff burner (not shown), or the like, is provided to ignite the fuel material in the solids, and thereafter the fuel material is self-combusted by the heat in the furnace section 22. The flue gases pass upwardly through the furnace section 22 and entrain, or elutriate, a majority of the solids. The quantity of the air introduced, via the air plenum 30, through the nozzles 26 and into the interior of the furnace section 22 is established in accordance with the size of the solids so that a circulating fluidized bed is formed, i.e. the solids are fluidized to an extent that substantial entrainment or elutriation thereof is achieved. This occurs in the upper portion of the furnace section 22 and in that area of the lower portion of furnace section closer to the front wall 12*a*, while a relatively dense bed of course material is formed in the lower portion of the furnace section. Thus the flue gases passing from the latter area into the upper portion of the furnace section 22 are substantially saturated with the solids as shown by the flow arrow A. However in that area of the furnace section 22 closer to the partition 20, some of the relatively course solids disengage from the flue gases due to the relatively low discharge velocities of the nozzles 26 in the latter area as shown by the flow arrow B. The disengaged solids fall on the angled partition wall section 20*b* and slide back into the dense bed in the lower portion of the furnace section 22 where they mix with the solids returning to the furnace section 22 from the recycle section 24 as will be described.

The quantity of air introduced into the furnace section 22 through the nozzles 26 in the above manner is less than that required for complete combustion of the fuel particles to reduce the formation of nitrous oxides, and the inlets 74a and 74b supply secondary air in sufficient quantities to complete the combustion.

The saturated flue gases in the upper portion of the furnace section 22 exit into the duct 34 and pass into the cyclone separator(s) 32 where the solids are separated from the flue gases. The cleaned flue gases from the separators 32 exit, via the ducts 35, and pass to the heat recovery section 36 for passage through the enclosure 38 and across the reheater 42, the superheater 44, and the economizer 46, before exiting through the outlet 38a to external equipment.

The separated solids pass from the separator(s) 32 through their diplegs 50 and are injected, via their corresponding J-valves 52 and conduits 54 and 54a, into the recycle section 24 of the enclosure 10. The separated solids enter the compartments 62a and 63a and pass through the latter compartments to the partitions 68a and 68c, respectively.

Air is introduced into the sections of the plenum 30 below the compartments 64a and 64b and is discharged through the corresponding nozzles 26 into the latter compartments at a higher velocity than the velocity of the air introduced, in a similar manner, into the inlet compartments 62a and 63a. The solids thus pass from the inlet compartments 62a and 63a, through the openings 58a and 59a in the partitions 58 and 59, respectively, and into the compartments 64a and 64b where they are fluidized and pass across the heat tube banks 70a and 70b, respectively. As shown by the flow arrows in FIGS. 2 and 3 a portion of the solids then pass from the compartments 64a and 64b, through the openings 56a and 57a in the partitions 56 and 57, respectively, and into the compartment 60a, while the remaining portion flows back over the partitions 58 and 59 and into the outlet troughs 62b and 63b respectively. In the compartment 60a the solids pass over the partition 68b and into outlet trough 60b. The solids then exit the outlet troughs 60b, 62b and 63b and pass into the furnace section 22 via the respective openings 20c aligned with the troughs. The solids mix during their passage from the upper portion of the outlet troughs 60b, 62b and 63b to the lower portions therefore before exiting via the openings 20c. Since the recycle section 24 is formed integrally with the furnace section 22, it operates at temperatures sufficient to combust the solid fuel particles passing therethrough.

Feedwater is introduced to and circulated through the flow circuit described above in a predetermined sequence to convert the feed water to steam and to reheat and superheat the steam. To this end, the heat transferred from the solids in the compartments 64a and 64b to the fluid flowing through the tube banks 70a and 70b can be used to provide reheat and/or full or partial superheat. For example, a portion of the tube banks 70a and 70b can function to provide primary superheating, while the remaining portions can provide finishing superheating.

During initial start up and low load conditions the fluidizing air flow through the nozzles 26 extending below the compartments 64a and 64b is turned off and the air flow through the nozzles extending below the inlet compartments 62a and 63a is turned on. This allows the solids in the compartments 62a and 63a to build up until their levels exceed the height of the partitions 68a and 68c, respectively, causing the solids to overflow into the outlet troughs 62b and 63b, respectively. The solids then pass, via the openings 20c, into the furnace section 22. Since the compartments 62 and 63 do not contain heat exchanger tubes, they function as a direct bypass for the solids flow so that start up and low load operation can be achieved without exposing the tube banks 70a and 70b to the hot recirculating solids.

The solids inventory circulating through the system is controlled by selectively controlling the discharge of relatively course spent solids from the furnace section 22 by the drain pipe 76a, and the discharge of relatively fine spent solids from the recycle section 24 by the drain pipes 76b and 76c.

The following advantages are achieved by the process and system of the present invention:

1. Since the secondary air is discharged, via the nozzles 72, through the partition section 20b, which, in effect, is located near the center of the enclosure 10, the mixing of the secondary air, the primary air from the nozzles 26 and the fuel particles is enhanced, resulting in increased combustion of the fuel particles.

2. The technique of introducing primary air into the furnace section 22 at varying velocities via the nozzles 26 draws the solids from the recycle section 24 into the furnace section 22 which improves the internal recirculation of the solids, stabilizes the solids, and enables both the external and the internal recirculation of the solids to be controlled.

3. The angled partition wall section 20b provides a "return slide" for the disengaged course material which enhances mixing and avoids choking of the circulating solids.

4. The recycled solids can be passed directly from the J-valve(s) 52 to the furnace section 22 via the compartments 62 and 63 during start-up or low load conditions prior to establishing adequate cooling steam flow.

5. The ability to drain solids from both the furnace section 22 and the recycle section 24 allows for flexible control of the available solids to accommodate changing firing rates.

6. The recycle section 24 is formed integrally with the furnace section 22 and operates at a temperature sufficient to combust the fuel particles therein which further increases the efficiency of the system.

7. The partition 20 reduces the effective area in which fluidized air is introduced into the circulating bed in the furnace section 22 and therefore reduces the primary air requirements for this section.

8. The combination of the bubbling fluidized bed in the recycle section 24 and the circulating fluidized bed in the upper portion of the furnace section 22 allows for the former to serve as a reservoir for the latter at low loads, and to serve as a source of solids at higher loads.

It is understood that several variations can be made in the foregoing without departing from the scope of the present invention. For example, a series heat recovery arrangement can be provided with superheat, reheat and/or economizer surface, or any combination thereto.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion process comprising the steps of forming a furnace section and a recycle section in an enclosure, supporting a bed of combustible material in said furnace section, introducing air into said bed of combustible material at different locations in said enclosure to fluidize said combustible material, discharging a mixture of flue gases and entrained material from said furnace section, separating said entrained material from said flue gases, passing said separated flue gases to a heat recovery section, passing said separated material into and through said recycle section, and varying the velocities of said fluidizing air along said different locations so that said separated material is drawn from said recycle section back into said furnace section.

2. The process of claim 1 wherein said separated material passes from said recycle section into an area of said furnace section adjacent said recycle section and wherein said step of varying comprises the step of fluidizing said material in said area of said furnace section at a lower velocity than the velocity of said air in the remaining portion of said furnace section to cause said separated material to flow from said recycle section to said furnace section.

3. The process of claim 2 wherein the velocity of said air introduced to said furnace section progressively increases in a direction from said area across said furnace section to cause said separated material to flow from said recycle section to said area of said furnace section.

4. The process of claim 1 further comprising the step of controlling the velocity of said air so that said material in said area of said bed spaced from said first area is entrained and transported upwardly to the upper portion of said furnace section and the material in said first area disengages from said air and returns to said fluidized bed.

5. The process of claim 1 further comprising the step of combusting said separated material in said recycle section.

6. The process of claim 1 further comprising the step of removing heat from the separated material in said recycle section.

7. The process of claim 1 further comprising the step of fluidizing the separated material in said recycle section.

8. The process of claim 1 further comprising the steps of dividing said heat exchange section into a bypass compartment for receiving said separated material and a heat exchange compartment, passing said separated material from said bypass compartment directly to said furnace section; or from said bypass compartment, through said heat exchange compartment and then to said furnace section.

9. The process of claim 8 wherein said last step of passing comprises the step of selecting fluidizing said separated material in said bypass compartment and said heat exchange compartment.

10. A fluidized bed combustion system comprising an enclosure, a partition disposed in said enclosure to define a furnace section and a recycle heat exchange section in said enclosure, a bed of combustible particulate material formed in said furnace section, means for introducing air into said bed in quantities sufficient to fluidize said material and insufficient to completely combust said material means for introducing additional air through said partition and into said furnace section in quantities sufficient to completely combust said material, a separating section for receiving a mixture of flue gases and entrained particulate material from the fluidized bed in said furnace section and separating said entrained particulate material from said flue gases, a heat recovery section for receiving said separated flue gases, and means for passing said separated material from said separating section to said recycle section and from said recycle section back to said furnace section.

11. The system of claim 10 further comprising means for fluidizing said recycle section.

12. The system of claim 10 wherein air introducing means introduces air across said furnace section at varying velocities to induce the flow of said separated material from said recycle section to said furnace section.

13. The system of claim 10 further comprising openings formed in said partition for permitting said separated solids to pass from said recycle section to said furnace section.

14. The system of claim 10 wherein at least a portion of the walls of said enclosure are formed by tubes, and further comprising fluid flow circuit means for passing fluid through said tubes to transfer heat generated in said furnace section to said fluid.

15. The system of claim 14 wherein said flow circuit means further comprises means for passing said fluid through said in a heat exchange relation to the separated material in said recycle section to transfer heat from said separated material to said fluid to control the temperature of the separated material passed from said heat exchange compartment to said furnace section.

16. The system of claim 10 further comprising means for dividing said recycle heat exchange section into a bypass compartment for receiving said separated material from said separating section, and means for selectively passing said separated material from said bypass compartment, through said heat exchanger compartment and to said furnace section or from said bypass compartment directly to said furnace section.

17. The system of claim 16 wherein said latter passing means comprises means for selectively fluidizing said separated material in said bypass compartment and said heat exchange compartment to cause flow of said separated material.

18. A fluidized bed combustion system comprising an enclosure, partition means disposed in said enclosure for defining a furnace section and a recycle section in said enclosure, means for supporting a bed of combustible material in said furnace section, means for introducing air into said bed of combustible material at different locations in said enclosure to fluidize said combustible material, means for permitting a mixture of flue gases and entrained material to discharge from said furnace section, means for separating said entrained material from said flue gases, heat recovery means for receiving said separated flue gases from said separating means, means for passing said separated material into and through said recycle section, and means for varying the velocities of said fluidizing air along said different areas so that said separated material is drawn from said recycle section back into said furnace section.

19. The system of claim 18 wherein said separated material passes from said recycle section into an area of said furnace section adjacent said recycle section and wherein said varying means comprises means for fluidizing said material in said area of said furnace section at a lower velocity than the velocity of said air in the remaining portion of said furnace section to cause said separated material to flow from said recycle section to said furnace section.

20. The system of claim 19 wherein said varying means progressively increases the velocity of said air introduced to said furnace section in a direction from said area across said furnace section to cause said separated material to flow from said recycle section to said area of said furnace section.

21. The system of claim 18 further comprising means for dividing said heat exchange section into a bypass compartment for receiving said separated material and a heat exchange compartment, and means for passing said separated material from said bypass compartment directly to said furnace section, or from said bypass compartment, through said heat exchange compartment and then to said furnace section.

22. The system of claim 25 wherein said last-mentioned passing means comprises means for selecting fluidizing said separated material in said bypass compartment and said heat exchange compartment.

23. The system of claim 18 further comprising means for controlling the velocity of said air so that said material in said area of said bed spaced from said first area is entrained and transported upwardly to the upper portion of said furnace section and the material in said first area disengages from said air and returns to said fluidized bed.

24. The system of claim 18 further comprising means for combusting said separated material in said recycle section.

25. The system of claim 18 further comprising means for removing heat from the separated material in said recycle section.

26. The system of claim 18 further comprising means for fluidizing the separated material in said recycle section.

27. A fluidized bed combustion process comprising the steps of forming a furnace section and a recycle section in an enclosure, supporting a bed of combustible material in said furnace section, introducing air into said bed of combustible material at different locations in said enclosure to fluidize said combustible material, discharging a mixture of flue gases and entrained material from said furnace section, separating said entrained material from said flue gases, passing said separated material into at least one inlet passage in said recycle section, passing said separated material from said inlet passage to a compartment in said recycle section, removing heat from the separated material in said compartment, passing a portion as of said separated material from said compartment to an outlet passage, in said recycle section, passing said portion of separated material from said outlet passage to an outlet trough disposed at the end of said outlet passage, passing the remaining portion of said separated solids from said compartment to an outlet trough disposed at the end of said inlet passage, and passing said separated sections from said outlet troughs back to said furnace section.

28. The process of claim 27 further comprising the step of fluidizing the separated material in said compartment of said recycle section.

29. The process of claim 27 further comprising the steps of passing said separated material from said inlet passage, through said outlet trough disposed at the end of said inlet passage and then to said furnace section.

30. The process of claim 27 wherein said separated material passes from said recycle section into an area of said furnace section adjacent said recycle section and wherein said step of varying comprises the step of fluidizing said material in said area of said furnace section at a lower velocity than the velocity of said air in the remaining portion of said furnace section to cause said separated material to flow from said recycle section to said furnace section.

31. The process of claim 30 wherein the velocity of said air introduced to said furnace section progressively increases in a direction from said area across said furnace section to cause said separated material to flow from said recycle section to said area of said furnace section.

32. The process of claim 27 further comprising the step of controlling the velocity of said air so that said material in said area of said bed spaced from said first area is entrained and transported upwardly to the upper portion of said furnace section and the material in said first area disengages from said air and returns to said fluidized bed.

33. The process of claim 27 further comprising the step of combusting said separated material in said recycle section.

* * * * *